US008836487B2

(12) United States Patent
Shin

(10) Patent No.: US 8,836,487 B2
(45) Date of Patent: Sep. 16, 2014

(54) INTEGRATED REMOTE CONTROLLER AND METHOD OF SELECTING DEVICE CONTROLLED THEREBY

(75) Inventor: Jin Chul Shin, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/064,869

(22) Filed: Apr. 21, 2011

(65) Prior Publication Data

US 2011/0199196 A1 Aug. 18, 2011

Related U.S. Application Data

(62) Division of application No. 11/415,276, filed on May 2, 2006.

(30) Foreign Application Priority Data

Jul. 15, 2005 (KR) ..... 10-2005-0064390
Jul. 15, 2005 (KR) ..... 10-2005-0064391
Jul. 15, 2005 (KR) ..... 10-2005-0064392

(51) Int. Cl.
*G08C 19/12* (2006.01)
*G08C 23/04* (2006.01)
*G08C 17/02* (2006.01)

(52) U.S. Cl.
CPC ..... *G08C 23/04* (2013.01); *G08C 2201/32* (2013.01); *G08C 2201/20* (2013.01); *G08C 17/02* (2013.01)
USPC ... 340/13.24; 340/12.1; 340/12.5; 340/12.35; 725/81; 345/158

(58) Field of Classification Search
CPC ..... G08C 17/02; G08C 17/00; G08C 19/12; G07C 9/00182; G07C 2009/00793; A63H 30/04; H04W 88/027; G05D 1/0011; G06K 7/0008; G06K 19/0723; G06K 7/10029; A01K 11/006; G01S 13/82
USPC ..... 340/13.24, 13.25, 12.5, 12.1; 725/81, 725/62; 345/156, 158
See application file for complete search history.

(56) References Cited

U.S. PATENT DOCUMENTS 5,554,980 A * 9/1996 Hashimoto et al. ..... 345/158
6,127,941 A 10/2000 Van Ryzin (Continued)

FOREIGN PATENT DOCUMENTS

KR 10-2005-0001702 1/2005

OTHER PUBLICATIONS

U.S. Appl. No. 11/415,276, filed May 2, 2006, Jin Chul Shin, Samsung Electronics Co., Ltd.
U.S. Office Action dated May 7, 2009 issued in the file history of U.S. Appl. No. 11/415,276.
U.S. Office Action dated Oct. 29, 2009 issued in the file history of U.S. Appl. No. 11/415,276.

(Continued)

*Primary Examiner* — Omer S Khan
(74) *Attorney, Agent, or Firm* — Staas & Halsey LLP

(57) ABSTRACT

An integrated remote controller and a method of selecting a device controlled thereby are disclosed. The present invention is implemented such that it can store position data of devices to be controlled by the integrated remote controller; recognize devices around the integrated remote controller and displaying the devices; determine as to whether an angular velocity of the integrated remote controller is varied, if the recognized devices are plural; if the angular velocity is varied, sense movement direction of the integrated remote controller based on the angular velocity to search for a device to be controlled by a user; and display a control menu of the device to be controlled by the user.

3 Claims, 9 Drawing Sheets

(56) References Cited

U.S. PATENT DOCUMENTS

| | | | | |
|---|---|---|---|---|
| 6,925,410 | B2 | 8/2005 | Narayanan | |
| 2004/0208588 | A1* | 10/2004 | Colmenarez et al. | 398/115 |
| 2005/0057369 | A1 | 3/2005 | Lai | |
| 2005/0094610 | A1 | 5/2005 | de Clerq et al. | |
| 2005/0172321 | A1* | 8/2005 | Kakuda | 725/81 |
| 2006/0050052 | A1* | 3/2006 | Mekenkamp et al. | 345/156 |

OTHER PUBLICATIONS

U.S. Office Action dated May 7, 2010 issued in the file history of U.S. Appl. No. 11/415,276.

Office Action issued in co-pending U.S. Appl. No. 11/415,276 mailed, Mar. 14, 2012.

U.S. Final Office Action mailed Oct. 31, 2012 in corresponding U.S. Appl. No. 11/415,276.

* cited by examiner

INTEGRATED REMOTE CONTROLLER AND METHOD OF SELECTING DEVICE CONTROLLED THEREBY

CROSS-REFERENCE TO RELATED APPLICATIONS

This application is a divisional and claims priority to U.S. application Ser. No. 11/415,276, filed May 2, 2006, which in turn claims the benefit of Korean Patent Application Nos. 10-2005-0064390, 10-2005-0064391, and 10-2005-0064392, all of which are filed on Jul. 15, 2005 in the Korean Intellectual Property Office, the disclosure of which is incorporated herein by reference.

BACKGROUND

1. Field

The present invention relates to an integrated remote controller technology, and, more particularly, to an integrated remote controller and a method of selecting a device controlled thereby, which are capable of searching for devices in a range of control of an integrated remote controller via bi-directional communication, such as picture recognition, infrared communication, RF communication, or of automatically selecting a device that a user wishes to control based on detection of angular velocity (or user's hand movement) of the integrated remote controller, etc.

2. Description of the Related Art

Recently, with remote controlling technology becoming more common now remote controllers are controlling various electric appliances used in the home, the number of remote controllers therefore have increased in each home. As the number of remote controllers are increased in each home such that they cannot be properly cared for or that a user has difficulty to find a desired remote controller, an integrated remote controller has been developed to make a single remote controller include all the functions of various remote controllers.

Korean Patent Publication No. 10-2005-0001702 discloses an integrated remote controller which includes: a function storage unit for storing information of a plurality of functions for devices controlled by remote control signals; function group storage unit for storing information of more than one function stored in the function storage unit, in order, according to user's selection; a display for displaying information of functions which are stored in the function group storage unit or function storage unit; a user input unit for selecting a plurality of functions, wished by a user, of function information displayed on a display, in order, or moving to select the plurality of functions, or simultaneously performing the plurality of selected functions; a controller for receiving input signals from the user input unit and performing commands corresponding to the input signals; and a remote control signal output unit for outputting remote control key code values corresponding to the function information when performing functions for devices. The related art integrated remote controller is operated such that, when function buttons are pressed by a user, a function list is displayed on an LCD area, and then when a selection button and an execute button for a corresponding function are pressed by the user, the selected function is executed.

However, the related art integrated remote controller has disadvantages in that, when a device is to be controlled while another device is being controlled, in which the functions between the device and another device are different from one another, since a corresponding function must be searched for again, to search for a desired function, after escaping from a current function, the search path should be relatively long. For example, when an air-conditioner is activated while a TV volume is adjusted, the user must escape a volume adjustment function of the TV and then search and select a Power On function of an air-conditioner, such that the searched paths are complicated.

BRIEF SUMMARY

Additional aspects and/or advantages of the invention will be set forth in part in the description which follows and, in part, will be apparent from the description, or may be learned by practice of the invention.

Therefore, it is an aspect of the invention to provide an integrated remote controller and a method of selecting a device controlled thereby, which are capable of easily searching for devices in a range of control of an integrated remote controller via bi-directional communication, such as picture recognition, infrared communication, or RF communication, etc.

It is another aspect of the invention to provide an integrated remote controller and a method of selecting a device controlled thereby, which are capable of automatically selecting a device that a user wishes to control based on detection of movement of the integrated remote controller through angular velocity of the integrated remote controller.

In accordance with an aspect of the present invention, there is provided a method for recognizing control devices of an integrated remote controller which displays icons of identified devices, comprising the steps of: storing images of various types of devices as picture data; taking images of the devices by a camera; comparing images outputted from the camera with the picture data, and identifying the devices whose picture was taken by the camera; and displaying icons of the identified devices.

According to an aspect of the present invention, the picture data includes images which are obtained in a state wherein pattern marks are attached onto the various types of devices, and wherein, when the pattern marks are searched in the image outputted from the camera, the pattern marks are compared with a plurality of pattern mark of the devices in the picture data, and the device whose picture was taken by the camera is identified.

According to an aspect of the present invention, the picture data includes images which are obtained in a state wherein color marks are attached onto the various types of devices, and wherein, when the color marks are searched in the image outputted from the camera, the color marks are compared with a plurality of color marks of the devices in the picture data, and the device whose picture was taken by the camera is identified.

According to an aspect of the present invention, there is provided an integrated remote controller comprising: a camera for taking pictures of devices around the integrated remote controller; a recognition data storage unit for storing picture data of the devices which was obtained previously; a controller for comparing the images taken by the camera with picture data stored in the recognition data storage unit, such that the device in the image can be recognized; and a display for displaying the recognized device.

According to an aspect of the present invention, the picture data includes images which are obtained in a state wherein pattern marks or color marks are attached onto the various types of devices, and wherein, when the pattern marks or color marks are searched in the image outputted from the camera, the pattern marks or color marks are compared with a plurality of pattern marks or a plurality of color marks of the devices in the picture data, and the device whose picture was taken by the camera is identified.

According to an aspect of the present invention, the controller restricts a range of picture recognition if the number of devices whose picture was taken by the camera is over the reference number, such that only the reference number of the devices can be displayed on the display.

According to an aspect of the present invention, there is provided an integrated remote controller comprising: an infrared transmitting/receiving unit for receiving device identification signals transmitted from a plurality of devices; a recognition data storage unit for storing ID numbers of the plurality of devices; a controller for comparing the ID numbers of the respective devices, which are in the device identification signals, with the ID numbers stored in the recognition data storage unit, such that a device for transmitting the device identification signal can be identified; and a display for displaying the device identified by the controller.

According to an aspect of the present invention, the plurality of devices transmit the device identification signals to the infrared transmitting/receiving unit, if they receive device identification request signals transmitted from the infrared transmitting/receiving unit.

According to an aspect of the present invention, the plurality of devices periodically generate the device identification signals.

According to an aspect of the present invention, there is provided an integrated remote controller comprising: an RF transmitting/receiving unit for performing RF communication with respective RF transmitting/receiving devices which are installed in partitioned indoor spaces; a recognition data storage unit for storing a list of devices located in indoor spaces in which the respective RF transmitting/receiving devices are installed; a controller for searching for a device in indoor spaces in which one of the RF transmitting/receiving devices is installed, based on the list, in which the RF transmitting/receiving device is connected to the RF transmitting/receiving unit; and a display for displaying the device searched for by the controller.

According to an aspect of the present invention, there is provided a method for recognizing control devices of an integrated remote controller comprising the steps of: previously, storing ID numbers of a plurality of devices; receiving a device identification signals transmitted from at least one of the plurality of devices; comparing ID numbers of the respective devices, which are in device identification signals, with previously stored ID numbers, to identify the device transmitting the device identification signals; and displaying the identified device.

According to an aspect of the present invention, there is provided a method for recognizing control devices of an integrated remote controller comprising the steps of: storing a list of devices in indoor spaces in which respective RF transmitting/receiving devices are installed; recognizing one of the respective RF transmitting/receiving devices, in which the RF transmitting/receiving device is connected to the integrated remote controller; searching for a device in indoor spaces in which the RF transmitting/receiving device connected to the integrated remote controller is installed, based on the list; and displaying the searched device.

According to an aspect of the present invention, there is provided an integrated remote controller comprising: a picture-taking unit for taking pictures of devices around the integrated remote controller; a recognition data storage unit for storing picture data, which is obtained by taking the devices pictures, and position data of the devices; an angular velocity sensor for sensing variation of an angular velocity when the integrated remote controller moves its position; a controller for comparing images taken by the picture taking unit with picture data stored in the recognition data storage unit, to recognize the device whose picture was taken, and recognizing a device to be controlled by the user, using the angular velocity sensed by the angular velocity sensor and the position data, if the recognized devices are plural; and a display for displaying the device recognized by the controller or a control menu of the device to be controlled by the user.

According to an aspect of the present invention, the controller serves to sense movement direction of the integrated remote controller based on the angular velocity, and search for a device in the movement direction based on the position data to select the device as a device to be controlled by the user.

According to an aspect of the present invention, the controller searches for movement direction of the integrated remote controller when the magnitude of the angular velocity sensed by the angular velocity sensor is over a reference value.

According to an aspect of the present invention, the controller restricts a range of picture recognition, if the number of the devices whose picture was taken by the picture taking unit is over a reference number, such that only the reference number of the devices can be displayed on the display.

According to an aspect of the present invention, there is provided an integrated remote controller comprising: a communication unit for performing bi-directional communication with devices around the integrated remote controller; a recognition data storage unit for storing position data of the devices; an angular velocity sensor for sensing variation of angular velocity when the integrated remote controller moves its position; a controller for recognizing devices located around the integrated remote controller based on device identification signals transmitted from the devices, and recognizing devices to be controlled by the user, using the angular velocity sensed by the angular velocity sensor and the position data if the recognized devices are plural; and a display for displaying the devices recognized by the controller or a control menu of the devices to be controlled by the user.

According to an aspect of the present invention, the controller serves to sense the movement direction of the integrated remote controller based on the angular velocity, and select the device in the movement direction of the integrated remote controller as a device to be controlled by the user, based on the position data.

According to an aspect of the present invention, the controller searches for the movement direction of the integrated remote controller when the magnitude of the angular velocity sensed by the angular velocity sensor is over a reference value.

According to an aspect of the present invention, the communication unit includes an infrared transmitting/receiving unit or an RF transmitting/receiving unit.

According to an aspect of the present invention, there is provided a method for selecting control devices of an integrated remote controller comprising the steps of: storing position data of devices to be controlled by the integrated remote controller; recognizing devices around the integrated remote controller and displaying the devices; determining as to whether an angular velocity of the integrated remote controller is varied, if the recognized devices are plural; if the angular velocity is varied, sensing movement direction of the integrated remote controller based on the angular velocity to search for a device to be controlled by a user; and displaying a control menu of the device to be controlled by the user.

According to an aspect of the present invention, the method further comprises: recognizing a device located in the movement direction of the integrated remote controller referring to the position data, if the movement direction of the integrated remote controller is sensed, to select the device as a device to be controlled by the user.

According to an aspect of the present invention, the operation of recognizing is performed such that a picture taking unit of the integrated remote controller takes pictures of the devices, or an infrared transmitting/receiving unit of the integrated remote controller receives device identification signals of the devices, or an RF transmitting/receiving unit receives ID numbers of an RF transmitting/receiving device which is connected to the RF transmitting/receiving unit.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
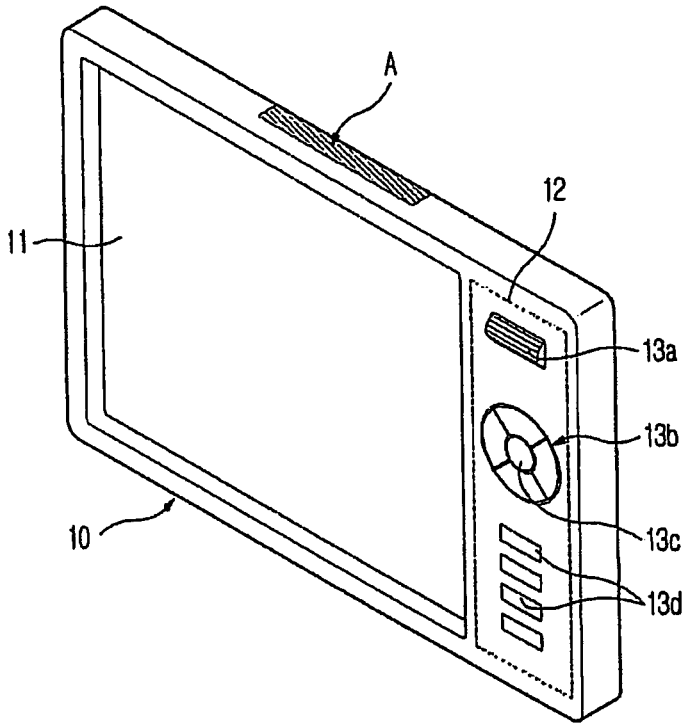
FIG. 1 is a perspective view of an integrated remote controller according to embodiments of the present invention.
Figure 2:
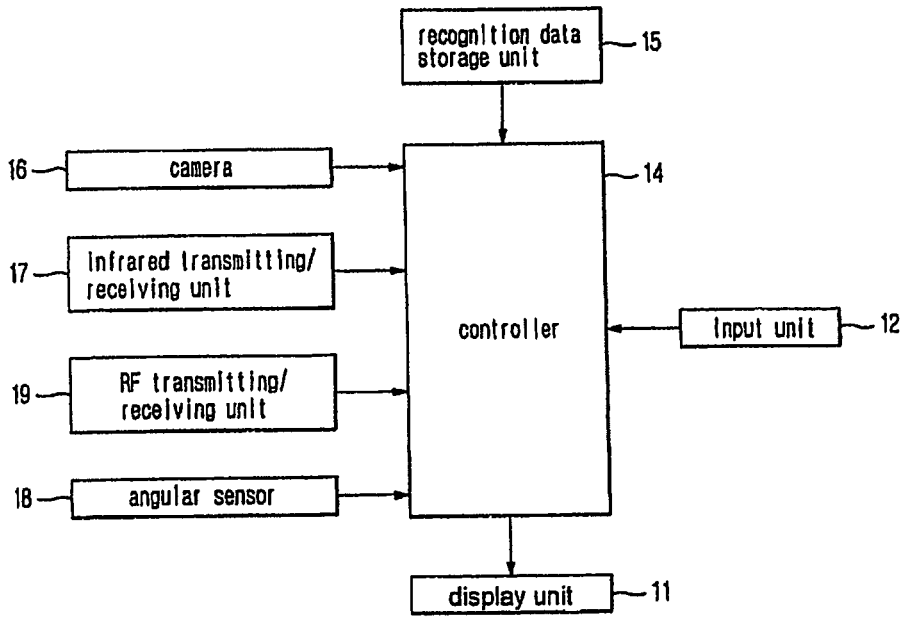
FIG. 2 is a block diagram of the integrated remote controller of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures. As shown in FIG. 1 and FIG. 2, the integrated remote controller 10 includes a display 11, an input unit 12, a camera 16, an infrared transmitting/receiving unit 17, a radio frequency (RF) transmitting/receiving unit 19, a recognition data storage unit 13, an angular velocity sensor 18, and a controller 14 according to embodiments of the present invention.

The display unit 11 is implemented with an LCD panel, and a touch panel for detecting a coordinate of a position which is touched by a user and performing an operation set by the touch input of the user. The display unit 11 displays production icons (for example, a TV button for TV control, a VCR button for a VCR, etc.) of each device such that control menu of various devices can be selected by user's touch input, and displays a control menu icon (for example, a Power ON icon and Power Off icon which are displayed when a user touches a TV icon) of the selected device, etc.

The input unit 12 includes a wheel 13*a*, direction buttons 13*b*, a selection button 13*c*, and various buttons 13*d*. The wheel 13*a* adjusts a control target value (for example, brightness) according to an amount of wheel rotation. The direction buttons 13*b* serves to move among a plurality of icons displayed on the display unit 11. The selection button 13*c* serves to select an icon that a user wishes.

Figure 3:
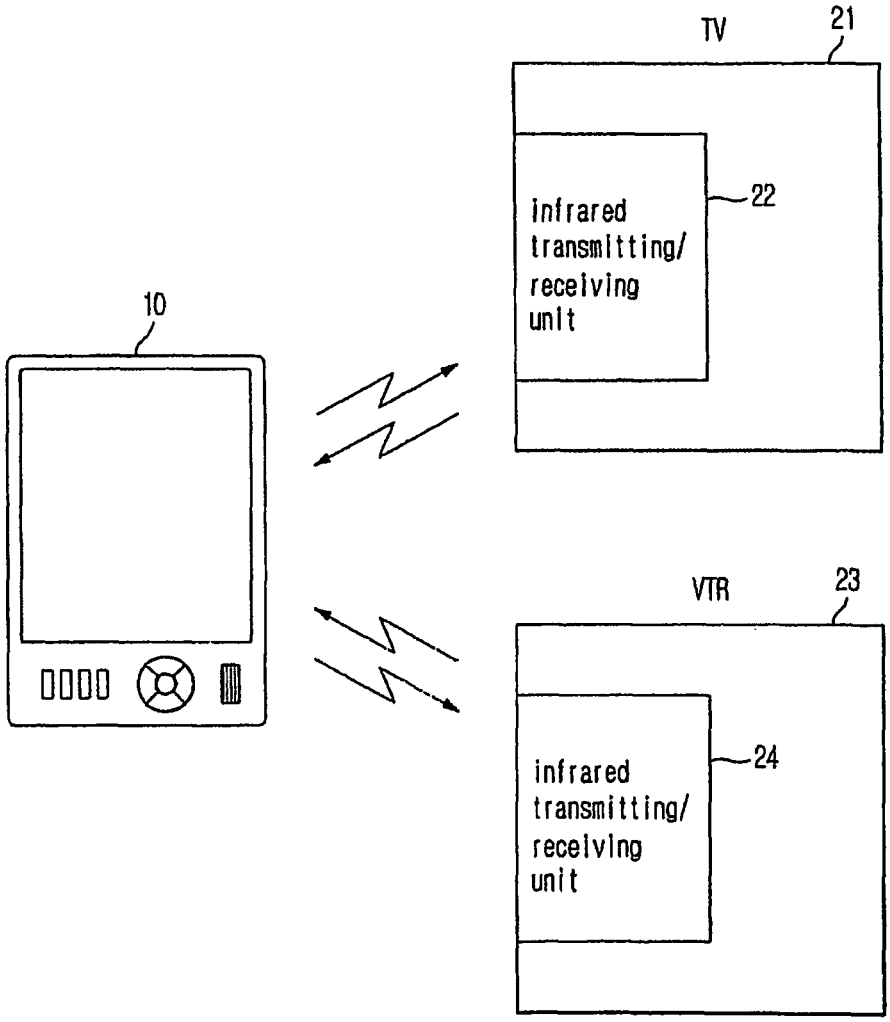
FIG. 3 is a schematic block diagram for describing a method for recognizing devices using an integrated remote controller via infrared communication.

The integrated remote controller 10 performs infrared communication with each device through the infrared transmitting/receiving unit 17 such that it can recognize the device and a control menu selected by a user can be transmitted to a corresponding device. In order that the integrated remote controller 10 recognizes the devices therearound, the infrared transmitting/receiving unit 17 of the integrated remote controller 10 periodically transmits device identification request signals to respective devices (for example, TV 21 and VTR 23 in FIG. 3). When infrared transmitting/receiving units 22 and 24 installed to the respective devices (TV 21 and VTR 23 of FIG. 3) receives the device identification request signals, the device identification signals including identification (ID) numbers of the respective devices are transmitted to the infrared transmitting/receiving units 17 of the integrated remote controller 10. The device identification signals transmitted from the respective devices are transmitted to the controller 14, such that the controller 17 can recognize the respective devices. It is understood that the identification (ID) numbers may be omitted or can be symbols, not limited to numbers.

Although the embodiment according to the present invention is implemented such that, when device identification request signals of the infrared transmitting/receiving unit 17 are received, the infrared transmitting/receiving units 22 and 24 of the respective devices 21 and 23 generate device identification signals, such embodiment can be modified such that the infrared transmitting/receiving units 22 and 24 can voluntarily and/or periodically transmit device identification signals regardless of device identification request signals. It is understood that identification signals can be sent when requested by a user.

Similar to the infrared transmitting/receiving unit 17, the radio frequency (RF) transmitting/receiving unit 19 is communicated with the respective electric appliances via RF communication such that the integrated remote controller 19 can recognize devices therearound. In order to recognize the devices around the integrated remote controller via RF communication, additional RF transmitting/receiving devices can be installed in indoor spaces which are previously partitioned, and ID numbers of the respective RF transmitting/receiving devices and devices located in indoor spaces, in which the respective RF transmitting/receiving devices are installed, must be previously inputted to the recognition data storage unit 15. As such, in a state wherein the RF transmitting/receiving devices are installed in indoor spaces, respectively, when a user enters one of the indoor spaces with the integrated remote controller 10, the RF transmitting/receiving unit 19 of the integrated remote controller 10 perform RF communication with RF transmitting/receiving devices installed in a corresponding indoor space to recognize the RF transmitting/receiving devices.

Figure 4:
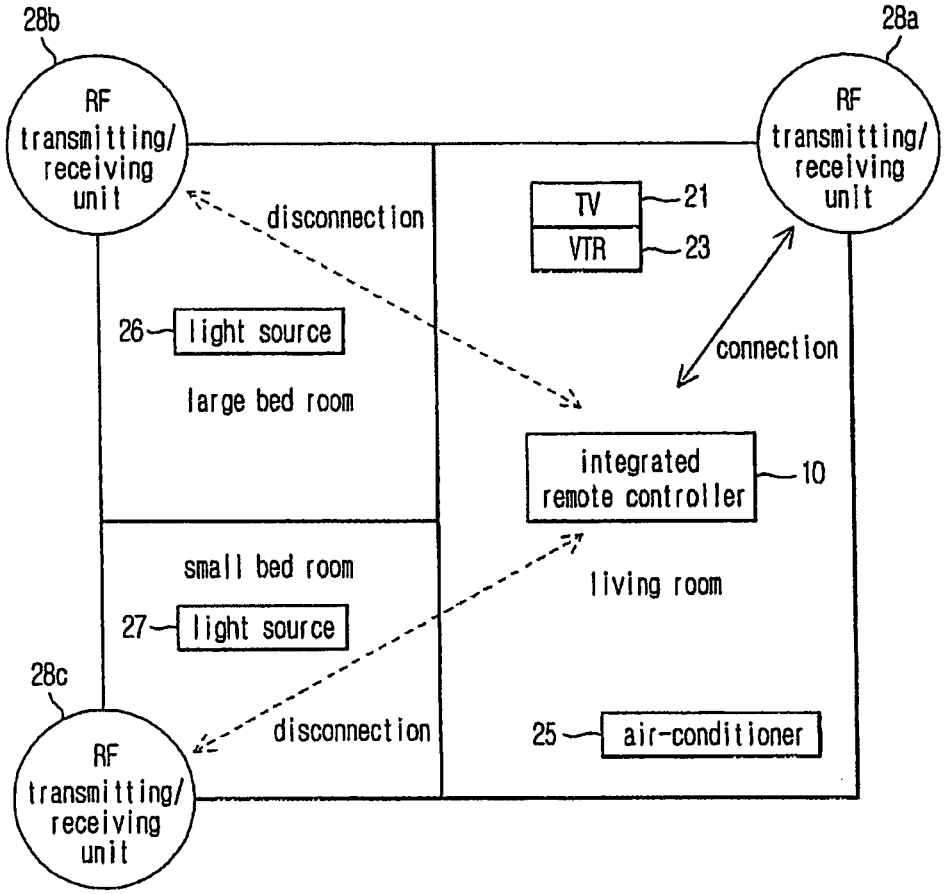
FIG. 4 is a schematic block diagram for describing a method for recognizing devices using an integrated remote controller via RF communication.

For example, as shown in FIG. 4, in a house having a living room in which a TV 21, VCR 23 and an air-conditioner 25 are located, and a large and small bedrooms each of which lamps 26 and 27 are located, the integrated remote controller 10 of the present invention is used, the recognition data storage unit 15 stores information such that the TV 21, VCR 23 and/or air-conditioner 25 are located in the living room and the lamps 26 and 27 are located in the large and small bedrooms, respectively, and then respective RF transmitting/receiving devices 28*a*, 28*b* and 28*c* are installed in the living room, and the large and small bedrooms. Here, the RF transmitting/receiving devices 28*a*, 28*b* and 28*c* of the living room, the large and small bedrooms, have ID numbers which are different from each other. In such a state, when a user enters the living room with the integrated remote controller 10 to control the TV 21, the RF transmitting/receiving unit 19 of the integrated remote controller 10 is connected to an RF transmitting/receiving device 28*a* in the living room to display product icons corresponding to the TV 21, VCR 23 and/or air-conditioner on the display unit 11. The user can select a TV icon of the product icons displayed on the display unit 11 such that a desired control command can be transmitted to the TV 21. It is also understood that the product icons can be displayed on the TV 21, for example. Here, the RF transmitting/receiving unit 19 is connected with the RF transmitting/receiving device 28*a* in the living room, but it is not connected to the RF transmitting/receiving devices 28*b* and 28*c*. On the other hand, the RF transmitting/receiving device 19 of the present invention may be implemented with various communication devices, such as RFID, wireless LAN, Blutooth, etc.

The recognition data storage unit 15 stores picture data, ID numbers of the respective devices, ID numbers of the respective RF transmitting/receiving devices, and list and location data of devices located in indoor spaces in which the respective RF transmitting/receiving devices are installed.

The picture data are associated with images of the respective devices to be controlled by the integrated remote controller 10, and are previously stored in the recognition data storage unit 15 before a user controls the devices using the integrated remote controller 10. Here, the picture data are stored in the recognition data storage unit 15, such that the user inputs device information, such as manufacturers and models of the devices, through a data storage guide tool which is previously set, matching the device information with an image of a corresponding device, whose picture was taken by a camera 16.

Figure 5:
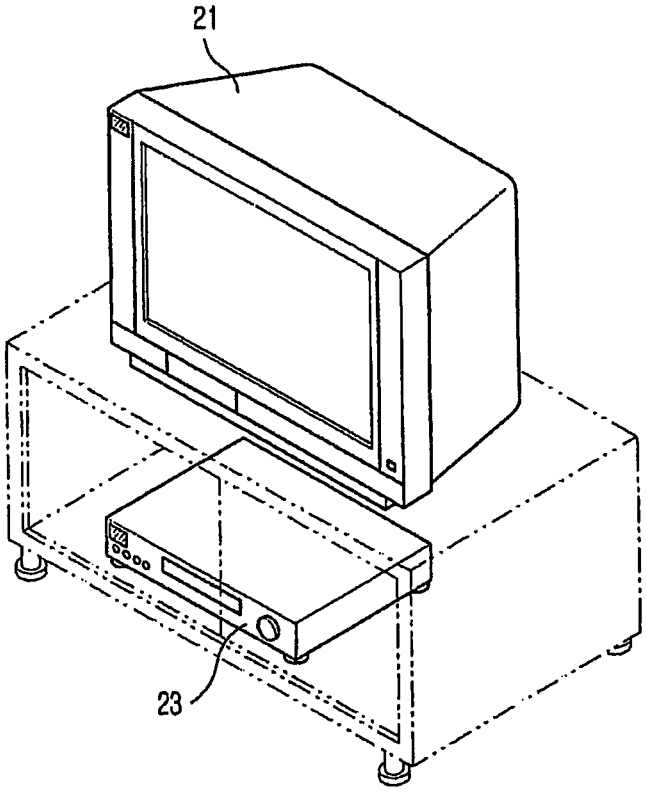
FIG. 5 is a perspective view of home appliances on which pattern marks are attached according to an embodiment of the present invention.
Figure 6:
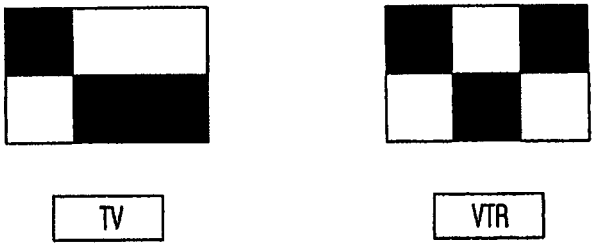
FIG. 6 is mark patterns attached to each device, which serve to identify devices related to an integrated remote controller via recognition of a picture.

Here, the picture data is formed by an image of a corresponding device, which is taken by a camera, and may be formed by pattern marks or color marks. More specifically, as shown in FIG. 5, the pattern marks are attached onto a predetermined position of the front of devices, such as a TV 21 and a VCR 23. Also, as shown in FIG. 6, the pattern marks are different from each other according to the type of devices. In a state wherein the pattern marks based on the types of the devices are stored as picture data, a pattern mark in the image taken by the camera 16 is compared with one of the pattern marks of the picture data such that the device corresponding the pattern mark in the image can be recognized.

As such, when the user inputs device information, such as manufactures and models of the respective devices, the device information as picture data is stored in a memory (a RAM, etc.) of the integrated remote controller while the device information is matched with images of corresponding devices, together with a control menu which is searched in a procedure for checking Multi Brand Remocon (MBR) data. Here, the MBR data include manufacturers of the respective devices, types of the respective devices, control menus of the respective devices, etc. These control menus are shown by icons on a display 11 when the user selects one of the devices.

ID numbers are allocated to the respective devices to be identified through infrared communication. The user recognizes the ID numbers of the respective devices through the infrared communication of the integrated remote controller 10 before controlling the respective devices. Namely, like the manner of picture recognition, the user inputs device information, such as manufacturers and models of the respective devices, through a data storage guide tool which is previously set, and stores the device information in the recognition data storage unit 15 in a state wherein the device information is matched with the ID numbers of the respective devices, which are obtained by the infrared communication. Here, the ID numbers of the respective devices are stored in a memory of the integrated remote controller together with a control menu of a corresponding device, which is obtained through a procedure for checking MBR data.

Like the ID numbers, the list of the devices should be previously stored in the recognition data storage unit 15 of the integrated remote controller before the integrated remote controller is used. Here, the devices are located at spaces in which the respective RF transmitting/receiving devices 28*a*, 28*b*, and 28*c* are installed. In order to store the list, the user sequentially moves indoors spaces, which are partitioned, and recognizes the ID numbers of the respective RF transmitting/receiving devices 28*a*, 28*b* and 28*c* in the respective indoor spaces as the integrated remote controller performs infrared communication with the respective RF transmitting/receiving devices 28*a*, 28*b* and 28*c*. Afterwards, the lists of the respective devices are stored through a data storage guide tool which is previously set. Here, the respective devices are located in the indoor spaces in which the respective RF transmitting/receiving devices 28*a*, 28*b* and 28*c*. The list includes device information, such as manufactures and models of the respective devices. Here, the device information is stored as a device list in the recognition data storage unit 15, matching with the ID numbers of the respective RF transmitting/receiving devices 28*a*, 28*b* and 28*c*, and also stored in another memory (a RAM etc.) in the integrated remote controller together with control menus of the respective devices, which are obtained in a procedure for checking MBR data. Such stored control menus are displayed as icons on the display 11 when the user selects one of the respective devices to control it.

Position data indicate points on a plane in which the respect devices in the indoor spaces are located. Like the picture data, the position data must be previously stored in the integrated remote controller 10 before the integrated remote controller 10 is used. The position data can be stored therein by various manners, but a drag-and-drop method is used, according to an aspect of the present invention.

For example, the display arrays icons of home appliances, which are generally used at home, left thereof, and shows a top view of indoor space of the home right thereof. In such a state, the user drags icons corresponding to his/her own appliances and drops them on the top view, one by one, which is referred to as drag-and-drop. When an icon of a device is dropped on the top view, the user searches for a point on the plane, at which the device is substantially located, and then drops the icon of the device to the point. If a user inputs position data of a living room in which, with respect to the entrance of his/her house, a TV and a VCR is located on the front thereof and an air conditioner is placed right thereof, the icons corresponding to the TV and VCR are dragged and then dropped to the front of the top view, and the icon corresponding to the air conditioner is dragged and then dropped to right of the top view. As such, when all locations of the respective devices are inputted on the top view, the inputted data is stored in the recognition data storage unit 15 as position data.

The angular velocity sensor 18 serves to sense rotation of the integrated remote controller 10, for example left/right rotation or up/down rotation. Namely, when the user waves his/her hand gripping the integrated remote controller 10, the angular velocity sensor 18 senses an angular velocity according to left/right movement and up/down movement of the integrated remote controller, and then outputs digital values corresponding thereto.

The controller 14 recognizes devices in control range of the integrated remote controller 10 through bi-directional communication, such as picture recognition or infrared communication, and RF communication, or controls an operation for searching for a device to be controlled by a user based on an output of the angular velocity sensor 18.

When images taken by the camera 16 are transmitted to the controller 14, the controller 14 compares the images with picture data stored in the recognition data storage unit 15 to recognize a device in the image. Here, the controller 14 identifies the device in the image taken by the camera 16, such that the image itself is compared with images of pictures data previously stored in the recognition data storage unit 15 or such that pattern marks or color marks attached on the respective devices are analyzed.

Also, the controller 14 checks ID numbers included in device identification signals which are transmitted from the respective devices via infrared communication, and then identifies a corresponding device. For example, in a state wherein the ID numbers of a TV and VCR, 01 and 03, are stored, respectively, if the ID number is checked by the integrated remote controller 10, the controller recognized that corresponding device is the TV.

In addition, the controller checks ID numbers of the RF transmitting/receiving device received through RF communication, such that the controller can recognize devices located in an indoor space in which a corresponding RF transmitting/receiving device is installed. Here, as described above, the RF transmitting/receiving unit 19 is connected to only the one of a plurality of RF transmitting/receiving devices, which is in an indoor space in which the integrated remote controller 10 is located, but is not connected to the remaining RF transmitting/receiving devices. Therefore, the controller 14 determines that the integrated remote controller is located in the indoor space in which the RF transmitting/receiving device currently connected thereto is installed, and displays icons of the devices located in a corresponding indoor space on the display unit 11.

Furthermore, the controller 14 searches for a device to be controlled by the user based on analysis of output of the angular velocity sensor 18. When the user indicates to a device controlled by him/her with the integrated remote controller 10, the angular sensor 18 senses an angular velocity to output it the controller 14. Then the controller 14 determines whether the controller 14 is moved left/right direction or up/down direction based on the output of the angular velocity sensor 18. Afterwards, the controller 14 searches for position data of a device at the indication direction of the integrated remote controller and selects the device that the user wants to control. More specifically, the controller 14 recognizes the devices in front of the integrated remote controller 10 through picture recognition or infrared communication, recognizes the current indication direction of the integrated remote controller 10, senses a variation of the angular velocity of the integrated remote controller to search its movement direction, and identifies the device in the direction of the integrated remote controller, as a device that the user desires to control, referring to position data. This procedure is described in detail with reference to FIG. 7 to FIG. 9.

Figure 7:
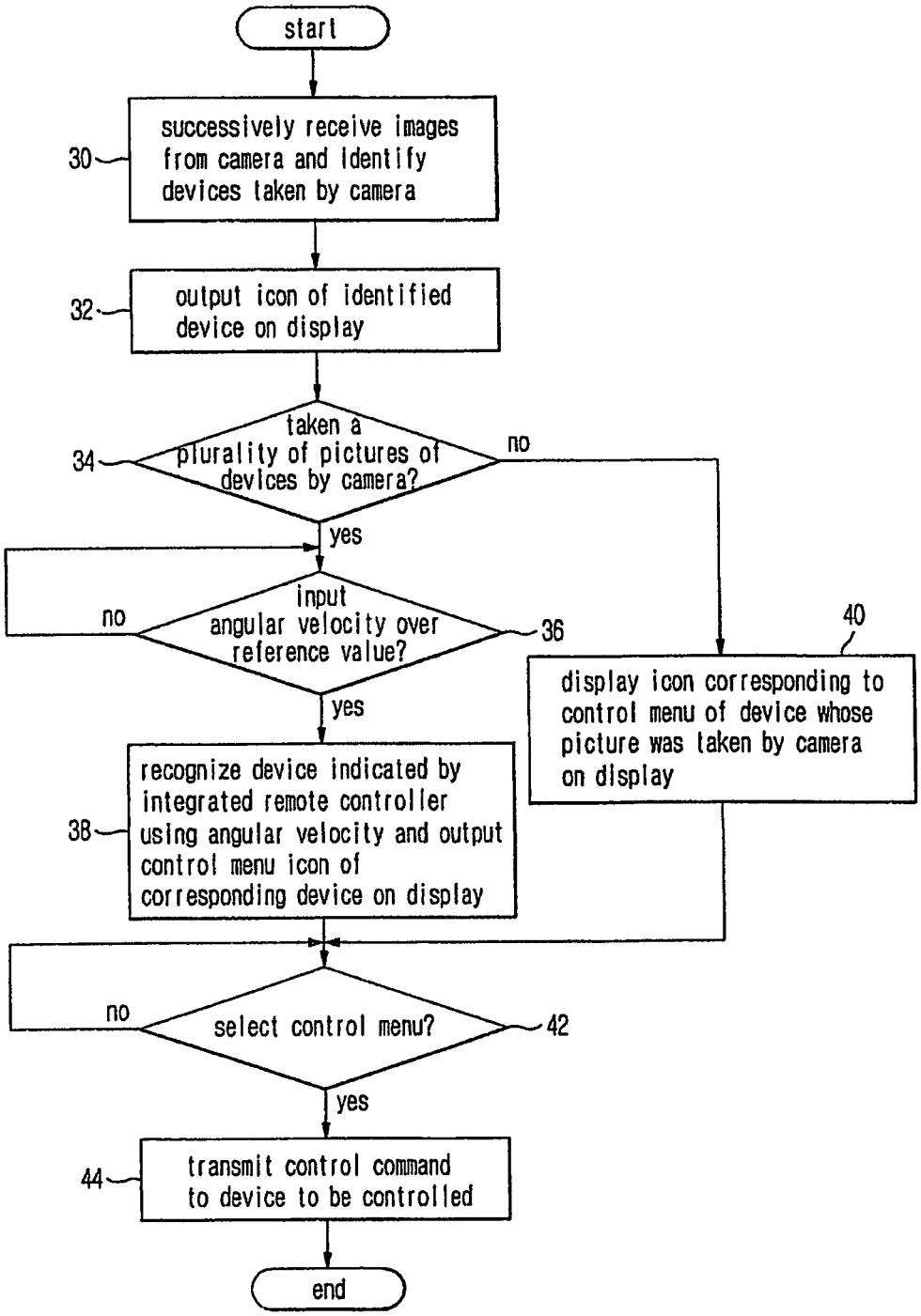
FIG. 7 is a flow chart for describing a method of selecting a control device controlled by an integrated remote controller according to a first embodiment according to the present invention.

Referring to FIG. 7, a method of selecting a control device controlled by an integrated remote controller according to an embodiment according to the present invention is described. When a power switch of an integrated remote controller is "ON" to control a device to be controlled by a user, an image taken by a camera 16 is outputted to a controller 14 in operation S30. The controller 14 compares the image outputted from the camera 16 with picture data of a recognition data storage unit 15 to identify devices in the images taken by the camera 16 in operation S30. Afterwards, the identified devices are displayed as icons on a display unit 11 in operation S32. Here, the controller 14 continuously receives images from the camera 16 to analyze them. When devices whose picture was taken by the camera are changed, the controller 14 changes icons of the devices to display them on the display unit 11. Also, when the number of the devices whose picture was taken by the camera is over the reference number, the controller 14 restricts a range of picture recognition such that only the reference number of icons can be displayed on the display unit 11. For example, in a state wherein the reference number of the icons is set to four, when the camera 16 takes six devices, the controller restricts the range of picture recognition such that only four devices pictures are taken by the camera 16 and then displays four icons of the devices whose picture was taken on the display unit 11. It is also understood that the number of devices displayed on the display unit is not limited to only four devices. It can be displayed more than four devices.

Next, the controller 14 determines whether the number of devices whose picture was taken by the camera is plural in operation S34. If the camera 16 takes a picture of a single device, the controller 14 searches for a control menu of the device in a memory and then displays an icon of the control menu on the display unit 11 in operation S40. On the other hand, if the camera 16 takes pictures of a plurality of devices, the controller 14 determines whether the angular velocity sensor 18 senses an angular velocity of over a reference value in operation S36. Here, the reference value is set to prevent the controller 14 from recognizing that the integrated remote controller 10 moves, due to noises, or errors like the integrated remote controller is moved. The reference value can be set to a proper value according to a specification of the angular velocity sensor 18.

If the angular velocity sensor 18 senses an angular velocity of over a reference value, the controller 14 detects the direction and amount of movement of the integrated remote controller 10 based on direction and magnitude of the angular velocity, as vector components. Afterwards, the controller 14 recognizes a device in the direction of the integrated remote controller 10 based on position data in operation S38. For example, in an indoor space wherein an audio is adjacent to right of the TV and VCR, when a user makes the integrated remote controller indicate toward the TV, the VCR and the audio in order to control the audio, the camera 16 takes a picture of the TV, the VCR and the audio, and the display unit 11 shows icons corresponding thereto, respectively. Afterwards, when the user further turns the integrated remote controller 10 to the direction (or right) of the audio to control the audio, the angular velocity sensor 18 senses the angular velocity of the integrated remote controller 10 to output it to the remote controller. Then, the remote controller 14 recognizes that the integrated remote controller 10 is turned right, based on the direction of the angular velocity of the integrated remote controller 10. After checking that one of the currently taken pictures of the devices, which are located at the right, of the TV and VCR, is the audio from the position data, the controller recognized that the device to be controlled by the user is the audio. As mentioned above, the controller 14 analyzes images continuously inputted from the camera 16, and changes icons of devices on the display unit 11 when the devices taken by the camera 16 are changed. However, when the angular velocity sensor 18 senses an angular velocity of over the reference value, although the controller inputs changed images from the camera 16, it does not consider them.

When the controller searches the devices to be controlled by the user, it displays control menus of the devices on the display unit 11. Afterwards, the controller 14 determines whether one of the control menus is selected in operation S42. If the user touches the icon of the control menus on the display unit or selects one of control menus using the input unit 12, the controller 14 transmits the selected control command from the infrared transmitting/receiving unit 17 to the device to be controlled the in operation S44.

Figure 8:
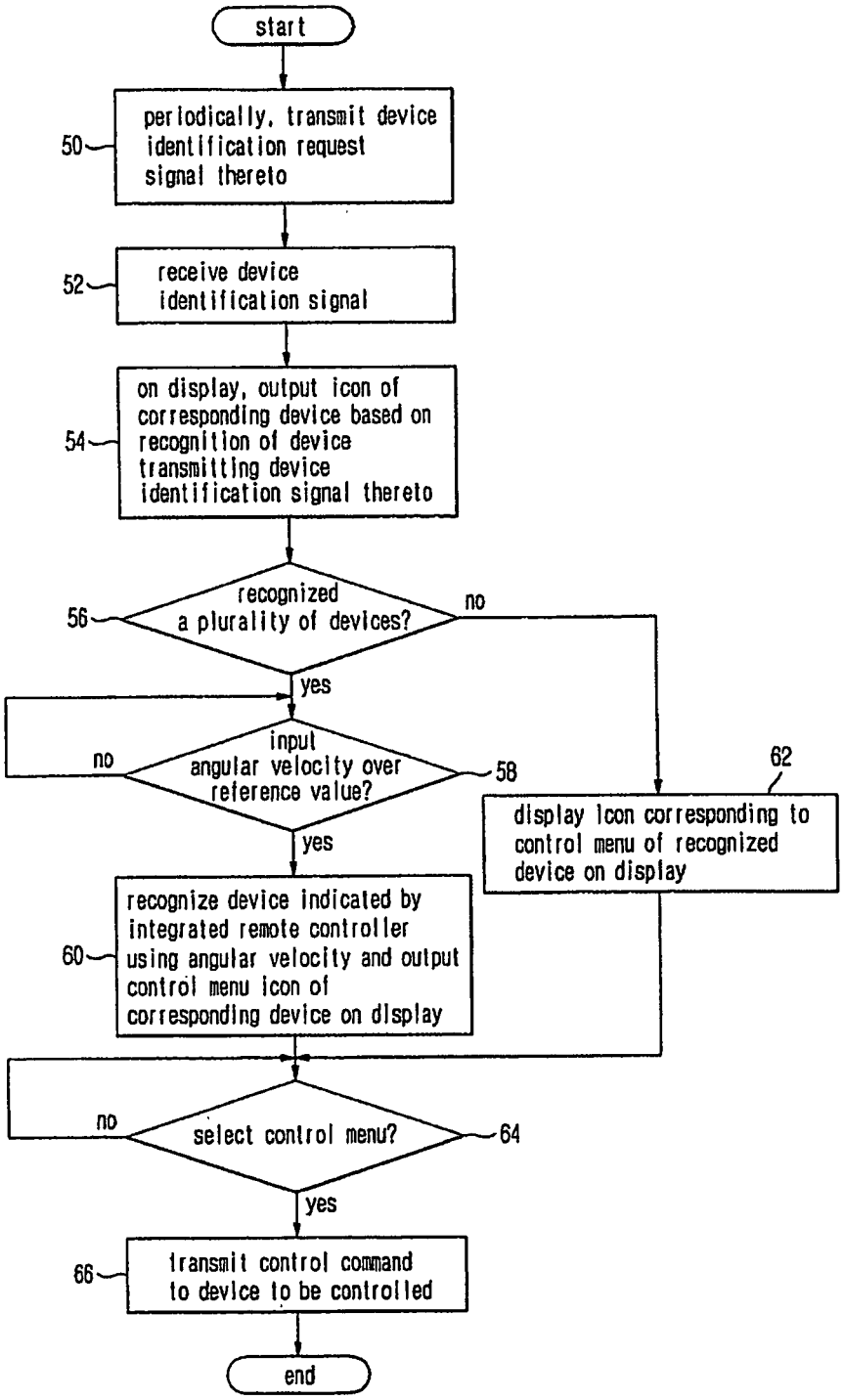
FIG. 8 is a flow chart for describing a method of selecting a control device controlled by an integrated remote controller according to a second embodiment according to the present invention.

Referring to FIG. 8, a method of selecting a control device controlled by an integrated remote controller according to an embodiment according to the present invention is described. When a power switch of an integrated remote controller is "ON" to control a device to be controlled by a user, an infrared transmitting/receiving unit 17 transmits device identification request signals thereto in step S50. When the device identification request signals are emitted from the integrated remote controller 10 in a radial direction, the infrared transmitting/receiving unit 17 of the devices receives the infrared signals corresponding to the device identification request signals in operation S52, in which the devices are in a range of propagation of the infrared signals. Afterwards, the infrared transmitting/receiving unit 17 transmits the device identification signals in the ID numbers of the respective devices thereto. The device identification signals from the respective devices are received by the infrared transmitting/receiving unit 17 of the integrated remote controller 10 and then inputted to the controller 14.

The controller 14 recognizes ID numbers in the device identification signals, and compares the ID numbers with those of the data storage unit 15 to identify devices in a range of propagation of the infrared emitted from the infrared transmitting/receiving unit 17 of the integrated remote controller 10. Afterwards, icons of the devices are displayed on the display 11 in operation S54. For this, the infrared transmitting/receiving unit 17 of the integrated remote controller 10 periodically transmits device identification request signals to the devices which are around the integrated remote controller 10, and receives device identification signals from the devices. The controller 14 analyzes the device identification signals, and changes icons of the devices on the display 1 when the received device identification signals are changed.

Next, the controller 14 determines whether the devices transmitting the device identification signals are plural in operation S56. If the device transmitting the device identification signals is a single, the controller searches a control menu of the device in a memory and then displays an icon of the control menu on the display unit 11 in operation S62. After that operations S64 to S66 are performed. However, if a plurality of devices transmit device identification signals thereto, operations S58 and S60, and operations S64 and S66 are performed in order. Here, operations S58 to S60, and operations S64 to S66 are identical to operations S36 to S38 and operations S42 to S44 of FIG. 7, respectively. Therefore such procedures are omitted for simplicity.

Figure 9:
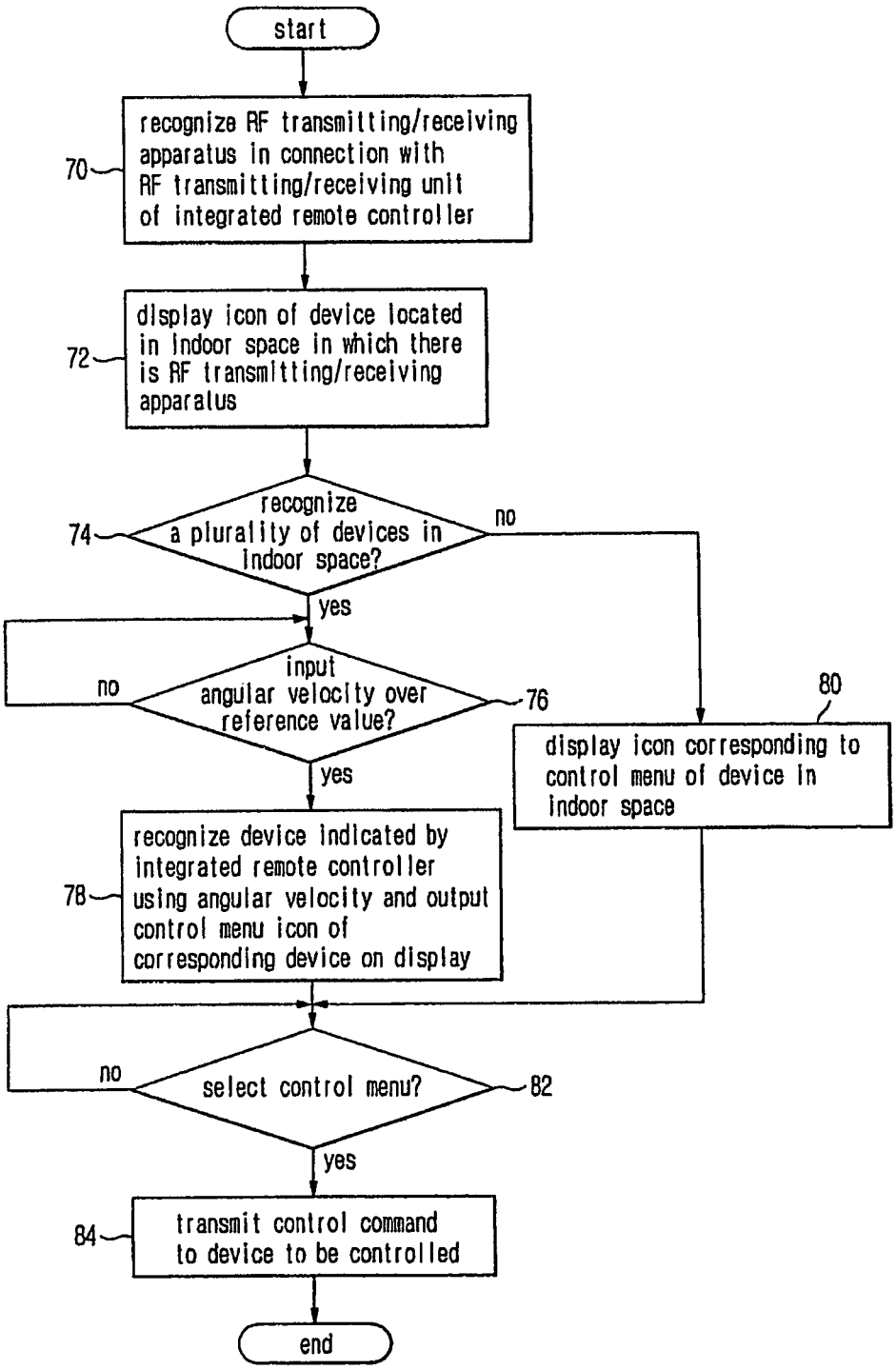
FIG. 9 is a flow chart for describing a method of selecting a control device controlled by an integrated remote controller according to a third embodiment according to the present invention.

With reference to FIG. 9, a method of selecting a control device controlled by an integrated remote controller according to an embodiment of the present invention is described. When a power switch of an integrated remote controller is "ON" to control a device to be controlled by a user, the controller 14 searches for one of a plurality of RF transmitting/receiving devices, which is connected to an RF transmitting/receiving unit 19, and checks the ID number of a corresponding RF transmitting/receiving device in operation S70. Afterwards, using ID numbers and a device list of the RF transmitting/receiving device, which are stored in the recognition data storage unit 15, devices in an indoor space in which the integrated remote controller is currently located are displayed as icons on the display 11 in operation S72. Here, when the user carries the integrated remote controller from one indoor space to other indoor space, an RF transmitting/receiving device is disconnected to the integrated remote controller and connected to an RF transmitting/receiving device installed in the other indoor space, thereby changing icons of the devices on the display 11.

Next, the controller 14 determines whether the number of devices in indoor space, in which the integrated remote controller 10 is located, is plural in operation S74. If the device is a single in the indoor space, the controller 14 searches for a control menu of a corresponding device in a memory and displays icons of the control menu on the displays unit 11 in operation S80. After that, operations 82 and 84 are performed. However, if a plurality of devices are in the indoor space, operations 76 to 78, and operations 82 to 84 are performed in order. Here, operations S76 to S78, and operations S82 to S84 are identical to operations S36 to S38 and operations S42 to S44 of FIG. 7. Therefore such procedures are omitted for simplicity.

Although the present invention is implemented with the integrated remote controller, it can be applied to a home pad, a web pad, a PDA and a mobile phone, etc.

Also, although the embodiment according to the present invention is implemented such that a camera 16, an infrared transmitting/receiving unit 17, and an RF transmitting/receiving device 19 are positioned in an upper portion (point A of FIG. 1) of the integrated remote controller, the camera 16, the infrared transmitting/receiving unit 17 and the RF transmitting/receiving device 19 can be installed other positions.

The present invention has advantages in that devices in a range of control of the integrated remote controller can be easily searched using picture or infrared communication, RF communication and bi-directional communication, thereby proving convenience to the user.

Also, the present invention has advantages in that a device to be controlled by a user can be easily searched for using angular velocity, after the devices are searched for using devices in a range of control of the integrated remote controller, thereby proving convenience to the user.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An integrated remote controller comprising:

a storage unit to store picture data associated with a plurality of devices and to store position data of the devices;

a camera to capture an image of the devices;

a communication unit;

a controller to recognize at least one device of the devices based on the image data captured by the camera and the picture data stored in the storage unit; and a display unit to display;

wherein, when the number of devices recognized by the controller is more than or equal to two, the display unit displays icons corresponding to the devices recognized by the controller and the controller selects one of the recognized devices based on a user's motion of the integrated remote controller, wherein the display unit displays a control menu of the device selected by the controller, wherein, when an user input is received via the control menu, the controller transmits a control command corresponding to the user input from the communication unit to the device recognized by the controller; and wherein the controller searches for a movement direction of the integrated remote controller when a magnitude of an angular velocity sensed by an angular velocity sensor is over a reference value.

2. The integrated remote controller of claim 1, wherein the communication unit includes an infrared transmitting/receiving unit or an RF transmitting/receiving unit.

3. A method for use in an integrated remote controller comprising:

storing picture data associated with a plurality of devices and position data of the devices;

capturing an image of the devices using a camera incorporated in the integrated remote controller;

recognizing at least one device of the devices based on the image captured by the camera and the picture data stored in the storage unit;

displaying device icons corresponding to the recognized devices on a display unit of the integrated remote controller when the number of devices recognized is more than or equal to two;

selecting one of the recognized devices based on a user's motion of the integrated remote controller; and displaying a control menu of the selected device on the display unit;

receiving an user input via the control menu displayed on the display unit;

transmitting a control command corresponding to the user input from the integrated remote controller to the recognized device; and searching for a movement direction of the integrated remote controller when a magnitude of an angular velocity sensed by an angular velocity sensor is over a reference value.

* * * * *